US008398228B2

(12) United States Patent
Nakamura

(10) Patent No.: US 8,398,228 B2
(45) Date of Patent: Mar. 19, 2013

(54) IMAGE FORMING APPARATUS

(75) Inventor: Masaki Nakamura, Tokyo (JP)

(73) Assignee: Konica Minolta Ij Technologies, Inc., Tokyo (JP)

( * ) Notice: Subject to any disclaimer, the term of this patent is extended or adjusted under 35 U.S.C. 154(b) by 502 days.

(21) Appl. No.: 12/610,934

(22) Filed: Nov. 2, 2009

(65) Prior Publication Data

US 2010/0118095 A1 May 13, 2010

(30) Foreign Application Priority Data

Nov. 11, 2008 (JP) ..... 2008-288584

(51) Int. Cl.
*B41J 2/01* (2006.01)

(52) U.S. Cl. ..... 347/102

(58) Field of Classification Search ..... 347/102
See application file for complete search history.

(56) References Cited

U.S. PATENT DOCUMENTS

| | | | | |
|---|---|---|---|---|
| 7,905,948 | B2 * | 3/2011 | Belelie et al. | 106/31.61 |
| 2004/0050292 | A1 * | 3/2004 | Nakajima et al. | 347/100 |
| 2004/0202956 | A1 * | 10/2004 | Takahashi et al. | 430/270.1 |
| 2007/0058020 | A1 * | 3/2007 | Wetjens et al. | 347/102 |
| 2007/0109382 | A1 | 5/2007 | Lafleche et al. | |
| 2007/0110958 | A1 | 5/2007 | Meyers et al. | |
| 2007/0120921 | A1 * | 5/2007 | Carlini et al. | 347/100 |
| 2007/0211110 | A1 * | 9/2007 | Iftime et al. | 347/52 |
| 2008/0074481 | A1 | 3/2008 | Doo | |
| 2009/0160924 | A1 * | 6/2009 | Pattekar et al. | 347/102 |
| 2009/0232857 | A1 * | 9/2009 | Peppas | 424/401 |
| 2009/0246403 | A1 | 10/2009 | Wetjens et al. | |
| 2010/0118095 | A1 * | 5/2010 | Nakamura | 347/102 |
| 2011/0074895 | A1 * | 3/2011 | Chretien et al. | 347/100 |
| 2011/0166306 | A1 * | 7/2011 | Stansbury et al. | 526/205 |

FOREIGN PATENT DOCUMENTS

| | | |
|---|---|---|
| JP | 2005126507 | 5/2005 |
| JP | 2007063553 | 3/2007 |
| JP | 2008100493 | 5/2008 |
| WO | 2007025893 | 3/2007 |
| WO | 2007058796 | 5/2007 |

* cited by examiner

*Primary Examiner* — Charlie Peng
(74) *Attorney, Agent, or Firm* — Lucas & Mercanti, LLP

(57) ABSTRACT

Provided is an image forming apparatus for an inkjet recording having improved bleed resistance and stickiness resistance of formed image, exhibiting excellent abrasion resistance and adhesion to the recording medium, and having capability of printing onto recording medium with low softening temperature. An image forming apparatus for an inkjet recording method that forms an image by jetting a photo-curable inkjet ink comprising a colorant, a photo-curable monomer, a photo-initiator and a gelling agent onto a recording medium, and photo-curing the ink by a light irradiation apparatus, wherein an illuminance of the light irradiation apparatus is 1 mW/cm$^2$ or more and 50 mW/cm$^2$ or less, the apparatus comprising: a warming section for warming the photo-curable inkjet ink at a temperature of 5 to 30° C. higher than a gelling temperature of the photo-curable inkjet ink, and a control section for controlling a surface temperature of the recording medium at a temperature of 5 to 30° C. lower than the gelling temperature of the photo-curable inkjet ink.

7 Claims, 3 Drawing Sheets

IMAGE FORMING APPARATUS

CROSS-REFERENCE TO RELATED APPLICATION

This application is based on Japanese Patent Application No. 2008-288584 filed on Nov. 11, 2008 with Japan Patent Office, the entire content of which is hereby incorporated by reference.

TECHNICAL FIELD

The present invention relates to an image forming apparatus for an inkjet recording by using photo-curable inkjet inks.

BACKGROUND

The inkjet recording method is currently achieving rapid development in various fields, because the high-definition image can be recordable by relatively simple apparatus. The inkjet recording method is applied to various fields and the recording medium or the inkjet inks are used just for each purpose. Recently, the recording speed is extremely increasing and the development of printer which has performances applicable for the short run printing.

Basically, in the inkjet recording method, low viscosity is required for the inkjet ink, because fine droplets of inkjet ink have to be ejected stably from inkjet head and the image is formed on the recording medium by depositing these droplets. However color mixing phenomena so called bleed tends to occur by depositing plural of inkjet inks having low viscosity on the recording medium. On the contrary, to use inkjet inks having high viscosity so as to prevent bleed presents a dilemma of unstable jetting from an inkjet head.

Several methods are proposed so as to solve this dilemma. For example, the image forming method using hot-melt inks is well known. In this image forming method using hot-melt inks, bleed is prevented by jetting the ink melted by heating from inkjet head and by solidifying ink instantaneously by cooling just after depositing on the recording medium. However this method still has problems such as abrasion or stickiness, when the ink is jetting on the recording medium such as film which cannot absorb ink inside.

Other candidate method is a method using photo-curable inkjet inks. In this method using photo-curable inkjet ink, bleed is prevented by containing photo-curable monomer and photo initiator in the ink and by solidifying ink by irradiating after deposition on the recording medium. However this method still has problem of insufficient bleed prevention, because it is difficult to irradiate light at the same time as ink deposition on the recording medium and time-lag remains between ink deposition on the recording medium and the light irradiation.

One method to solve problems in the above methods, a hot-melt type photo-curable inkjet ink is proposed which utilizes both advantages of a hot-melt ink and a photo-curable ink.

For examples, proposed is a method that utilizes an ink having a compound which can be gelled at low temperature, and the ink is ejected from an inkjet head under high temperature, is turned into a gel by cooling after deposition of the recording medium, and is cured by light irradiation (for example, Patent documents 1 and 2). A further similar method is proposed which utilizes an ink having thixotropic gel forming properties under low temperature (for example, Patent document 3). However, any proposed methods result in insufficient image quality such as remaining surface stickiness and abrasion resistance being lower than expected, when using an ultra-violet irradiation apparatus such as a high-pressure mercury vapor lamp affects deformation on a recording medium such as shrink film which is weak for heat and stable printing cannot be available.

On the other hand, as a method for using general photo-curable type inkjet ink, an inkjet printer by ultra-violet curing method is proposed which irradiates high illuminance light after irradiation of low illuminance light (for example Patent Document 4).

Further as a method for printing on a recording medium such as shrink film which is weak for heat, an inkjet printer by an ultra-violet curing method is proposed which irradiates low illuminance light in a long period by arranging two UV light sources before and after carriage along the transporting direction (for example, Patent Document 5).

However, because that above proposed inkjet recording method is based on a general photo-curable inkjet recording method, an ejected ink deposits on the recording medium with low viscosity, and there exists time lag between deposition of ejected ink and light irradiation. Therefore, bleed occurred during this time lag cannot be prevented enough, and an improvement of the bleed is insufficient. Furthermore, in the case of applying a hot-melt photo-curable inkjet ink as it is as the general photo-curable inkjet recording method, it was found that prevention of bleed after curing, surface stickiness and abrasion resistance proved to be incompatible and insufficient by these methods. The cause is realized by a different curing behavior between through high viscosity stage by gelling and directly from low viscosity ink.

Patent Document 1: Japanese Patent Application Publication (hereinafter also referred to as JP-A) No. 2005-126507
Patent Document 2: JP-A No. 2007-063553
Patent Document 3: WO2007/025893
Patent Document 4: JP-A No. 2008-100493
Patent Document 5: WO2007/058796

SUMMARY

In view of the foregoing, the present invention was achieved. An object of the present invention is to provide an image forming apparatus having improved bleed resistance and stickiness resistance of formed image, exhibiting excellent abrasion resistance and adhesion to the recording medium, and having capability of printing onto recording medium with low softening temperature.

The above object has been achieved by the following constitutions.

1. An image forming apparatus for an inkjet recording method that forms an image by jetting a photo-curable inkjet ink comprising a colorant, a photo-curable monomer, a photo-initiator and a gelling agent onto a recording medium, and photo-curing the ink by a light irradiation apparatus, wherein an illuminance of the light irradiation apparatus is 1 mW/cm$^2$ or more and 50 mW/cm$^2$ or less, the apparatus comprising:

a warming section for warming the photo-curable inkjet ink at a temperature of 5 to 30° C. higher than a gelling temperature of the photo-curable inkjet ink, and a control section for controlling a surface temperature of the recording medium at a temperature of 5 to 30° C. lower than the gelling temperature of the photo-curable inkjet ink.

2. The image forming apparatus for an inkjet recording of item 1, wherein the surface temperature of the recording medium is controlled at a temperature of 30° C. or higher and at 5 to 30° C. lower than the gelling temperature of the photo-curable inkjet ink.

3. The image forming apparatus for an inkjet recording of item 1 or 2, wherein a peak wavelength of a light emitted from the light irradiation apparatus is in a range of 230 nm or more and 330 nm or less.

4. The image forming apparatus for an inkjet recording described in any one of items 1 to 3, wherein the gelling temperature of the photo-curable inkjet ink is in a range of 40° C. or more and 80° C. or less.

According to the present invention, the image forming apparatus for an inkjet recording having improved bleed resistance and stickiness resistance of formed image, exhibiting excellent abrasion resistance and adhesion to the recording medium, and having capability of printing onto recording medium with low softening temperature could be provided.

DESCRIPTION OF THE ALPHANUMERIC DESIGNATIONS

1: Carriage
2: Piezo-type inkjet head
3: UV Light source
4: Recording medium

DESCRIPTION OF THE PREFERRED EMBODIMENT

Hereinafter, details of the best embodiment of the present invention will be described.

In view of the foregoing, the inventors of the present invention conducted diligent investigations. As a result, the following was discovered, and the present invention was achieved. An image forming apparatus having improved bleed resistance and stickiness resistance of formed image, exhibiting excellent abrasion resistance and adhesion to the recording medium, and having capability of printing onto recording medium with low softening temperature can be provided by an image forming apparatus for an inkjet recording method that forms an image by:

jetting a photo-curable inkjet ink comprising a colorant, a photo-curable monomer, a photo-initiator and a gelling agent onto a recording medium, and photo-curing the ink by a light irradiation apparatus, wherein an illumination intensity of the light irradiation apparatus is 1 mW/cm2 or more and 50 mW/cm2 or less, the apparatus comprising:

a warming section for warming the photo-curable inkjet ink at a temperature of 5 to 30° C. higher than a gelling temperature of, the photo-curable inkjet ink, and a control section for controlling a surface temperature of the recording medium at a temperature of 5 to 30° C. lower than the gelling temperature of the photo-curable inkjet ink.

The present invention will now be detailed.

<<Inkjet Recording Method>>

At first, the general outline of the inkjet recording method for forming the image of the present invention will be described.

(Method for Light Irradiation)

As a result of such diligent investigations for a method for the image forming to prevent bleed and to improve formed image on stickiness resistance, abrasion resistance and adhesion to the recording medium by using the hot-melt type photo-curable inkjet ink (hereinafter simply referred to as ink), it was found that these performances can be solved by using the light irradiation apparatus by controlling light illuminance within a determined range.

In the hot-melt type photo-curable inkjet ink relating to the invention, so as to prevent bleed, gelling occurred according to lowering temperature rapidly after depositing the melted ink on the recording medium, and then, the actinic irradiation for curing such as an ultra-violet ray is irradiated.

In the case of image forming by inkjet recording which uses general UV curable inkjet printer and general UV curable inkjet inks, not so big problems occurred in an ink ejection, stickiness, and abrasion resistance. However, in the case of an inkjet recording using a hot-melt photo-curable inkjet inks, trouble in an ink ejection cannot be solved and an image which satisfies all of bleed resistance, stickiness resistance, abrasion resistance and adhesion to the recording medium cannot be obtained.

Figure 2:
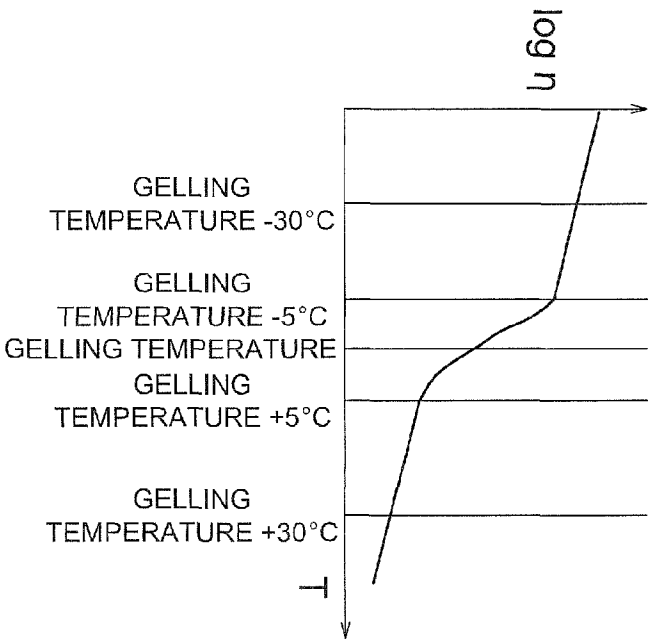
FIG. 2 is a schematic view showing the change of viscosity versus temperature for the holt-melt ink of the invention.
Figure 3:
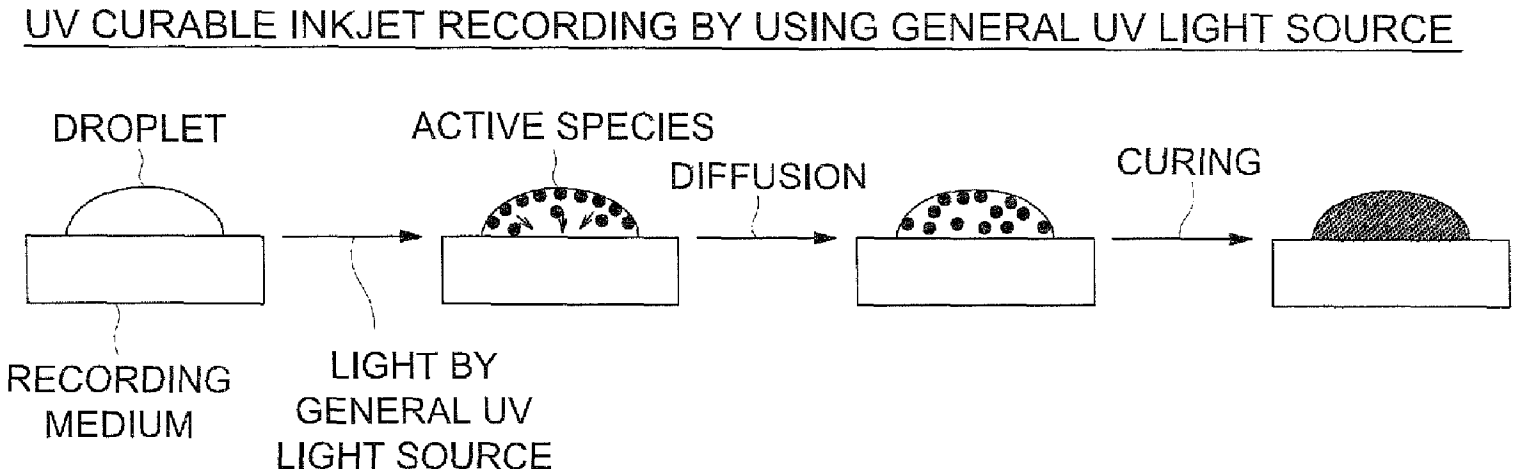
FIG. 3 is a schematic view showing a curing step of general UV curable ink.

These reasons are supposed as follows:

FIG. 2 shows a change of viscosity versus temperature for the holt-melt ink. Hot-melt ink contains a gelling agent so as to turn into gel at the time of a deposition on the recording medium. Gelling temperature is not changed sharply as a melting point or a boiling point at specific temperature, and shows broad temperature range for gelling. Therefore, it is expected that by ejecting or depositing an ink around the gelling temperature at which temperature a viscosity becomes stabilized, an image which can satisfy all of bleed resistance, stickiness resistance, abrasion resistance and adhesion to the recording medium can be obtained. However bleed resistance, stickiness resistance, abrasion resistance and adhesion to the recording medium were still insufficient, except for improving ink ejection. By considering a curing behavior after ink deposition, above problems were estimated by following mechanism:

Generally, UV curable ink contains a colorant which absorbs UV light. Therefore UV light can be irradiated enough on the surface of ink, but UV light cannot reach to a deep portion near a recording medium as shown in FIG. 3. Most activated species are generated at near surface portion of the deposited ink and diffused into the deep portion where UV light cannot reach. As a result, almost uniform curing to deep portion can be obtained.

Figure 4:
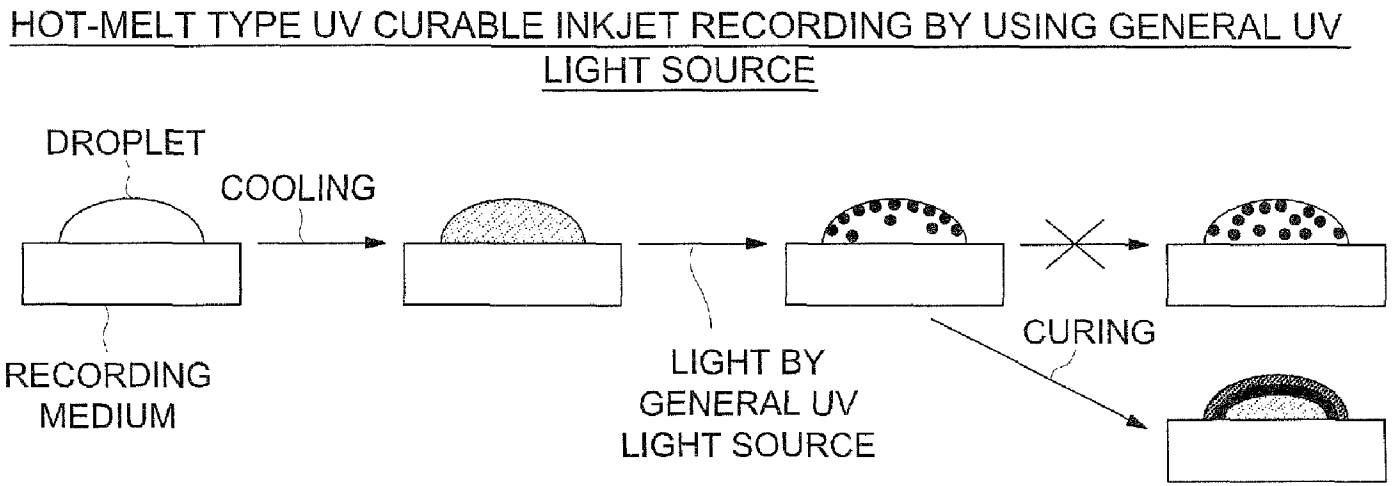
FIG. 4 is a schematic view showing a curing step of a hot-melt type UV curable ink using general UV light source.

In a hot-melt UV curable ink recording using general UV light source, ink is ejected from inkjet head under higher temperature than a gelling temperature so as to eject ink stably, cooled to turn to high viscous gel after deposition on a recording medium so as to prevent bleed, and the gel is converted to cured material and fixed to the recording medium by irradiation of UV light. The activated species cannot diffuse to inside and stays around surface portion after UV irradiation, because viscosity of gel of an ink droplet before UV irradiation is extremely higher than that of conventional UV inkjet recording ink. As a result of an extremely high rate polymerization, polymer having low degree of polymerization is formed at the surface portion. Besides, curing cannot proceed to deep portion near recording medium and appropriate curing can be occurred only at the intermediate portion. Above scheme are schematically shown in FIG. 4.

Therefore it was considered to be necessary to control for rapid diffusion of activated species formed on the surface of gel after cooled in a hot-melt UV curable ink recording as below: i) keeping a viscosity of a gel low so as to diffuse activated species, ii) optimizing an irradiation illuminance so as to prevent an excess generation amount of activated species and to prevent rapid curing at a surface of gel, and further curing is carried out slowly so that activated species can be diffused in viscosity of gel, iii) generating activated species step by step constantly so as to supply them even if dilute activated species are deactivated. Temperature of ejection and deposition, and illuminance of UV light were investigated so as to control viscosity before and after gelling and concentration of activated species.

As a result, an image as below was developed: stable ejection was kept by jetting a hot-melt UV-curable inkjet ink comprising a gelling agent from inkjet head at a temperature of 5 to 30° C. higher than a gelling temperature which can keep a constant viscosity within a certain amount of deviation of temperature; bleed was prevented by forming droplet on a recording medium at a temperature of 5 to 30° C. lower than the gelling temperature; stickiness resistance, abrasion resistance and adhesion to the recording medium were satisfied by controlling an illumination intensity of the UV light irradiation in 1 mW/cm2 or more and 50 mW/cm2 or less, generating activated species slowly, and curing whole ink droplet by rapid diffusion of activated species to a recording medium. Further, because of using UV light with low illuminance, an image can be printed on a recording medium having low softening point.

Lower limit exists in a light intensity of an irradiation, because activated species in a gel have to be active during diffusion. When an illuminance is lower than 1 mW/cm$^2$, curing becomes insufficient because that activated species are deactivated by influence of other compound, in both cases of radical polymerization using photo-radical initiator as a photo initiator and cationic polymerization using photo-acid generating agent as an initiator. The effect of the invention can be obtained by the illuminance of 1 mW/cm$^2$ or more and producing enough amounts of activated species for diffusing to a bottom of an ink droplet. According to the invention, the upper limit of an illuminance is 50 mW/cm$^2$. In a case of higher illuminance than 50 mW/cm$^2$, stickiness resistance, abrasion resistance and adhesion to the recording medium cannot be obtained, because that viscosity reaches higher enough to prevent diffusion of an activated species by curing rapidly at surface of droplet. More preferable illuminance is from 3 mW/cm$^2$ to 30 mW/cm$^2$ and it results in preferable stickiness resistance, abrasion resistance and adhesion to the recording medium.

So as to prevent bleed by gelling rapidly, it is necessary to control a surface temperature of the recording medium at a temperature of 0° C. or more and 5 to 30° C. lower than the gelling temperature of ink. In a case of a surface temperature of the recording medium is within 5° C. of the gelling temperature of ink, prevention of bleed becomes insufficient because that increase of viscosity and gelling slowly occurs after ink deposition on a recording medium. In a case of a surface temperature of the recording medium is 30° C. higher than the gelling temperature, stickiness resistance, abrasion resistance and adhesion to the recording medium decreases, because that viscosity of formed gel becomes excessively high and activated species diffuses excessively slow. Effect of the invention can be adequately obtained by controlling a surface temperature of the recording medium at a temperature of 0° C. or more and 5 to 30° C. lower than the gelling temperature of ink, because that gel which can prevent bleed is formed and activated species generated by UV irradiation can diffuse. As to a surface temperature of the recording medium, a temperature of 0° C. or more is necessary, because that at a temperature lower than 0° C., dew falls on a surface of recording medium and inhibits adhesion between ink and recording medium. More preferable effect of the invention can be obtained by heating recording medium at 30° C. or more, because of accelerating diffusion of activated species.

Further, as to stable jetting of inkjet ink, it is necessary to warm an ink ejected from inkjet head of the invention at a temperature of 5 to 30° C. higher than a gelling temperature of the ink and keep ink viscosity constant. To warm ink at a temperature of 10 to 30° C. higher than a gelling temperature of the ink is more preferable.

Herein preset temperature means the reference temperature set as temperature of ejecting ink. In a case of temperature of warmed ink 5° C. lower than a gelling temperature of the ink, stable ink ejection cannot be obtained because that viscosity of ink largely varies depending on a slight temperature variation of circumstances. On the other hand, in a case of temperature of warmed ink 30° C. higher than a gelling temperature of the ink, bleed resistance cannot be obtained because that cooling after deposition on a recording medium becomes insufficient and a recording medium is not fully cool for depositing successive color ink droplets.

Adjustment of the illuminance of irradiation, the temperature of the recording medium and the temperature of ejecting ink to the predetermined value of the invention results in improvement of abrasion resistance by increasing adhesion and prevention of unnecessary gloss.

According to the invention, a warming method for controlling a photo-curable inkjet ink at a temperature of 5° C. higher than a gelling temperature of a photo-curable inkjet ink includes a method which a photo-curable inkjet ink is filled in inkjet head after warming a photo-curable inkjet ink at a desired temperature and a method which an inkjet head filled with a photo-curable inkjet ink is warmed at a desired temperature.

Further, a method for controlling a surface temperature of a recording medium at a temperature of 5° C. lower than the gelling temperature of the photo-curable inkjet ink includes a method by heating or cooling a transported recording medium from its backside by a heat plate or a heat roller, a method by irradiating micro wave onto a recording medium from its recording side by using a hot air fan and micro wave, and a method of heating or cooling by irradiation of visible light or far-infrared light.

The illuminance relating to the invention can be measured by using Spectro photo meter USR-40D/V (manufactured by Ushio Inc.) with measuring pitch 10 nm.

(Irradiation Light Source)

The irradiation light source relating to the invention is a light source irradiating an effective actinic ray and is not limited thereto, preferably an ultra-violet irradiation light source. Generally, as wave length becomes shorter, a risk to human body increases and a light is difficult to reach to a deep portion because a material largely absorbs a light. On the other hand, as wave length becomes longer, a light is safe, but it is well-known that a light absorption per unit volume decreases because of decreasing a light absorption. According to the invention, a light wavelength is preferably from 230 nm to 330 nm, but is not limited thereto. In a case of using a light source having a wavelength shorter than 230 nm, there is possibility of a risk for human body by generating ozone. In a case of using a light source having a wavelength longer than 330 nm, especially in black ink, a light easily penetrates into inside, and because of insufficient curing of surface portion, stickiness tends to occur. Specific ultra-violet light source include a conventional light source such as a low pressure mercury-vapor lamp, a UV fluorescent lamp, a metal halide lamp, a high pressure mercury-vapor lamp, a light emission diode (LED). The light source having preferable wave length of from 230 nm to 330 nm include a low pressure mercury-vapor lamp (for sterilization), UV-B fluorescent lamp, 230 nm-330 nm LED and they are preferably usable in a ultra-violet irradiation apparatus for a heat sensitive recording medium because of low heat generation.

Next, the other conditions of the image forming apparatus of the present invention will be described.

(Total Ink Film Thickness after Ink Deposition)

In the present invention, after deposition of an ink on a recording medium and curing via irradiation of actinic radiation, the total ink film thickness is preferably 2-25 μm. Herein, the term "total ink film thickness" refers to the maximum value of ink film thickness of an image recorded on a recording medium. The meaning of the above total ink film thickness is the same as in cases in which recording is conducted via a single color ink-jet recording method, as well as a 2-color superimposing (secondary color), 3-color superimposing, or 4-color superimposing (white ink base) ink-jet recording method.

(Ink Droplet Amount)

With regard to the droplet amount ejected from each nozzle of the recording inkjet head relating to the invention, 1 to 100 pl is preferred. Amount of the droplet in this range is necessary for forming a precise image and can be used without troubles.

(Radiation Irradiation Conditions after Ink Deposition)

In the image forming apparatus of the present invention, with regard to actinic radiation irradiation conditions, actinic radiation is irradiated preferably 10 second or less after ink deposition, more preferably 0.001 second-5 second, and more preferably 0.001 second-2 second thereafter. In order to form highly detailed images, it is specifically critical that irradiation timing is as early as possible.

As an irradiation method of actinic radiation using line method or shuttle method, a method that a light source such as UV fluorescent lamp is placed on at least downstream of head along transportation direction is disclosed (for example, JP-A 2008-100493 and WO2007/058796). Further, in the case of shuttle method, a method is disclosed that a light source is placed on each of both sides of a head unit (JP-A 60-132767).

<<Photo-Curable Inkjet Ink>>

Next, the photo-curable inkjet ink of the present invention will be described in detail.

The photo-curable inkjet ink of the present invention is characterized by comprising at least a colorant, a photo-curable monomer, a photo-initiator and a gelling agent.

[Colorant]

As a colorant in the ink of the present invention, dye or pigment is used without any limitation. Pigment having good dispersion stability to ink components and excellent fastness is preferred. As pigments, organic or inorganic pigments described in color index below are usable without specifically limitation.

Examples of pigments for red or magenta include C.I. Pigment Red 3, 5, 19, 22, 31, 38, 43, 48: 1, 48: 2, 48: 3, C.I. 48: 4, 48: 5, 49: 1, C.I. 53: 1, 57: 1, 57: 2, 58: 4, 63: 1, C.I. 81, C.I. 81: 1, 81: 2, C.I. 81: 3, 81: 4, 88, 104, 108, 112, 122, 123, 144, 146, 149, 166, 168, 169, 170, 177, 178, 179, 184, 185, 208, 216, C.I. 226, 257, C.I. Pigment Violet 3, 19, 23, 29, 30, 37, C.I. 50, 88, C.I. Pigment Orange 13, 16, C.I. 20, C.I. 36.

Examples of pigments for blue or cyan include C.I. Pigment Blue 1, 15, 15: 1, 15: 2, C.I. 15: 3, 15: 4, 15: 6, 16, 17-1, 22, 28, 29, 36, and 60.

Examples of pigments for green include C.I. Pigment Green 7, 26, 36, and 50.

Examples of pigments for yellow include C.I. Pigment Yellow 1, 3, 12, C.I. 13, 14, 17, 34, 35, C.I. 37, 55, 74, 81, 83, 93, 95, 97, 108, 109, 110, 137, 138, 139, 153, 154, 155, 157, 166, 167, 168, 180, 185, and 193.

Examples of pigments for black include C.I. Pigment Black 7, 28, and 26.

Dispersion liquid in which pigment is preliminary dispersed in high concentration in water, solvent, and polymerizable monomer can be also available.

Pigment dispersing agent is preferably employed for dispersing pigment. As dispersing agents, listed may be active agents such as fatty acid salt, alkylsulfate, alkylester sulfate, alkyl sulfonic acid salt, sulfosuccinate, naphthalene sulfonic acid salt, alkyl phosphate, polyoxyethylene alkylene alkyleter phosphate, polyoxyethylene alkyl phenyl ether, polyoxyethylene polyoxypropylene glycol, glycerine ester, sorbitane ester, polyoxyethylene fatty acid amide and amine oxide; or block co-polymer, random co-polymer and salt thereof selected from 2 or more monomers from styrene, styrene derivatives, vinylnaphthalene derivatives, acrylic acid, acrylic acid derivatives, maleic acid derivatives, itaconic acid, itaconic acid derivatives, fumaric acid, and fumaric acid derivatives.

Pigments described above can be dispersed using, for example, a ball mill, sand mill, atreiter, roll mill, agitator, Henschel mixer, colloid mill, ultrasonic homogenizer, pearl mill, wet jet mixer or paint shaker. There may be added dispersing agents when dispersing a pigment.

A pigment dispersing agent is incorporated preferably in an amount of from 10 to 100% by weight, based on weight of the pigment.

Pigment particles preferably have an average particle size of 50 μm or more and 150 nm or less. Stability of dispersion can be increased by controlling the average particle size of pigment particles within the range defined above. As the result, clogging at head nozzles can be inhibited and jetting stability also improved. Further as ink transparency increases, curing sensitivity by actinic radiation can be increased in case of containing an actinic radiation curable compound described later.

With respect to the ink of the present invention, the average particle size can be controlled within above defined range by selecting or combining the means for example such as a selection of pigment, dispersant and dispersion media, dispersion condition, filtration condition.

Further with respect to the ink of the present invention, known dye, preferably an oil soluble dye may be used, as appropriate.

Specific examples of oil soluble dyes are described below; however the present invention is not limited thereto.

<Magenta Dye>

Specific examples of magenta dye include MS Magenta VP, MS magenta HM-1450, HM Magenta HSo-147 (products of Mitsui-Toatsu Chemicals), AIZEN SOT Red-1, AIZEN SOT Red-2, AIZEN SOT Red-3, AIZEN SOT Pink-1, SPIRON Red GEH SPECIAL (products of Hodogaya Chemical), RESOLIN Red FB 200%, MACROLEX Red Violet R, MACROLEX ROT5B (products of Bayer Japan), KAYASET Red B, KAYASET Red 130, KAYASET Red 802 (products of Nippon Kayaku), PHLOXIN, ROSE BENGAL, ACID Red (products of Daiwa Kasei), HSR-31, DIARESIN Red K (products of Mitsui-Kasei), and Oil Red (product of BASF Japan).

<Cyan Dye>

Specific examples of Cyan dye include MS Cyan. HM-1238, MS Cyan HSo-16, HM Cyan HSo-144, MS Cyan VPG (products of Mitsui-Toatsu Chemical), AIZEN SOT Blue-4 (product of Hodogaya Chemical), RESOLIN BR. Blue BGLN 200%, MACROLEX Blue RR, CERES Blue GN, SIRIUS SUPRA TURQ. Blue Z-BGL, SIRIUS SUPRA TURQ. Blue FB-LL 330% (products of Bayer Japan), KAYASET Blue FR, KAYASET Blue N, KAYASET Blue 814, Turq. Blue GL-5 200, Light Blue BGL-5 200 (products of Nippon Kayaku), DAIWA Blue 7000, Olosol Fast Blue GL (products of Daiwa Kasei), DIARESIN Blue P (product of Mitsui-Kasei), SUDAN Blue 670, NEOPEN Blue 808, and ZAPON Blue 806 (products of BASF Japan).

<Yellow Dye>

Specific examples of yellow dye include MS Yellow HSM-41, Yellow KX-7, Yellow EX-27 (products of Mitsui-Toatsu Chemical), AIZEN SOT Yellow-3, AIZEN SOT Yellow-6 (products of Hodogaya Chemical), MACROLEX Yellow 6G, MACROLEX FLUOR. Yellow 10GN (products of Bayer Japan), KAYASET Yellow SF-G, KAYASET Yellow 2G, KAYASET Yellow A-G, KAYASET Yellow E-G (products of Nippon Kayaku), DAIWA Yellow 330HB (product of Daiwa. Kasei), HSY-68 (product of Mitsui-Kasei), SUDAN Yellow 146, and NEOPEN Yellow 075 (products of BASF Japan).

<Black Dye>

Specific examples of Black dye include MS Black HSM-41, VPC (product of Mitsui-Toatsu Chemical), AIZEN SOT Black-5 (product of Hodogaya Chemical), RESORIN Black GSN 200%, RESORIN Black BS (products of Bayer Japan), KAYASET Black SF-G, KAYASET A-N (products of Nippon Kayaku), DAIWA Black 330HB (product of Daiwa Kasei), HSB-202 (product of Mitsui-Kasei), NEPTUNE Black X60, and NEOPEN Black X58 (products of BASF Japan).

Additive amount of pigment or oil soluble dye is preferably in the range of 0.1-20% by weight, more preferably in the range of 0.4-10% by weight. Excellent image quality can be obtained by 0.1% by weight or more and ink can keep proper viscosity for ejecting by 20% by weight or less. Further, mixture of 2 or more colorants may be usable for adjusting color.

[Photo-Curable Monomer]

Photo-curable monomer (hereinafter referred to as photo polymerizable compound) of the present invention will be described.

Photo polymerizable compound according to the present invention can be used without limitation. Among them, photo-cationic polymerizable compound or radical polymerizable compound can be usable.

(Photo-Cationic Polymerizable Compound)

There are used a variety of known cationic polymerizable monomers as cationic polymerizable compounds including epoxy compounds, vinyl ether compounds and oxetane compounds, as described in JP-A Nos. 6-9714, 2001-31892, 2001-40068, 2001-55507, 2001-310938, 2001-310937 and 2001-220526.

Aromatic epoxides are preferably a di- or poly-glycidyl ether, which is prepared by the reaction of an at least one aromatic nucleus-containing polyphenols or its alkylene oxide adduct with epichlorohydrin. Examples thereof include a di- or poly-glycidyl ether of bisphenol A or its alkylene oxide adduct, a di- or poly-glycidyl ether of a hydrogenated bisphenol A or its alkylene oxide adduct, and a novolac type epoxy resin, in which ethylene oxide and propylene oxide are cited as an alkylene oxide.

An alicyclic epoxide is preferably a cyclohexane oxide or cyclopentene oxide containing compound, which is obtained by epoxidation of a compound containing a cycloalkane ring such as cyclohexane or cyclopenetene, with an appropriate oxidizing agent such as hydrogen peroxide or a peracid.

Preferred aliphatic epoxides include di- or poly-glycidyl ether of an aliphatic polyhydric alcohol or its alkylene oxide. Typical examples thereof include alkylene glycol diglydyl ether such as ethylene glycol diglycidyl ether, propylene glycol diglycidyl ether or 1,6-hexanediol diglycidyl ether; polyglycidyl ether of a polyhydric alcohol such as di- or tri-glycidyl ether of glycerin or its alkylene oxide adduct; and diglycidyl ether of polyalkylene glycol such as diglycidyl ether of polyethylene glycol or its polyalkylene oxide adduct and diglycidyl ether of polypropylene glycol or its alkylene oxide adduct, in which ethylene oxide and propylene oxide are cited as an alkylene oxide.

Of these epoxides, an aromatic epoxide or an alicyclic epoxide is preferred in terms of quick-curability, and an alicyclic epoxide is specifically preferred. In the invention, epoxides, as described above may be used alone or in combination thereof.

Vinyl ether compounds usable in the invention include, for example, di- or tri-vinyl ether compounds such as ethylene glycol divinyl ether, diethylene glycol divinyl ether, triethylene glycol divinyl ether, propylene glycol divinyl ether, dipropylene glycol divinyl ether, butanediol divinyl ether, hexanediol divinyl ether, cyclohexanedimethanol divinyl ether and trimethylolpropane trivinyl ether; and monovinyl ether compounds such as ethyl vinyl ether, n-butyl vinyl ether, isobutyl vinyl ether, octadecyl vinyl ether, cyclohexyl vinyl ether, hydroxylbutyl vinyl ether, 2-ethylhexyl vinyl ether, cyclohexanedimethanol monovinyl ether, n-propyl vinyl ether, isopropyl vinyl ether, isopropenyl ether-O-propylene carbonate, dodecyl vinyl ether, diethylene glycol monovinyl ether, and octadecyl vinyl ether.

Of these vinyl ether compounds, di- or tri-vinyl ether compounds are preferred and divinyl ether compounds are specifically preferred. The foregoing vinyl ether compounds may be used singly or in combination thereof.

Oxetane compound is defined as a compound having an oxetane ring. All well-known oxetane compounds disclosed in JP-A Nos. 2001-220526 and 2001-310937 can be usable.

A method for producing compound having an oxetane ring is not limited and well-known methods for example oxetane synthesis method from diol disclosed in D. B. Pattison, J. Am. Chem. Soc., 3455, 79 (1957) can be usable.

(Radically Polymerizable Composition)

Next, radically polymerizable composition will be described.

In the ink according to the present invention, use of a radically polymerizable monomer is not limited. As a radically polymerizable monomer, disclosed is, for example, a photo-curable material using photo polymerizable compound and a photo curable resin by cationic polymerization in JP-A No. 7-159983, Examined Japanese Patent Application Publication (hereinafter referred to as JP-B) No. 7-31399, JP-A Nos. 8-224582 and 10-863; and recently a photo curable resin by cationic polymerization sensitized to longer wave length than visible light in JP-A Nos. 6-43633 and 8-324137.

A radically polymerizable compound according to the present invention is a compound having a radically polymerizable ethylenically-unsaturated bond. Any compound having at least one radically polymerizable ethylenically-unsaturated bond in the molecule may be usable, including a chemical form such as a monomer, oligomer, and polymer. Such a radically polymerizable monomer may be used individually, or combined use of at least 2 types at an appropriate ratio is applicable to enhance the targeted characteristics.

Examples of the compound having a radically polymerizable ethylenically-unsaturated bond includes unsaturated acids and salts thereof such as acrylic acid, methacrylic acid, itaconic acid, crotonic acid, isocrotonic acid, or maleic acid; esters, urethanes, amides, and anhydrides thereof, acrylonitrile and styrene, as well as various types of radically polymerizable compounds such as unsaturated polyesters, unsaturated polyethers, unsaturated polyamides, and unsaturated urethanes. Specifically, there are listed acrylic acid derivatives such as norbornene acrylate, 2-ethylhexyl acrylate, 2-hydroxyethyl acrylate, butoxyethyl acrylate, carbitol acrylate, cyclohexyl acrylate, tetrahydrofurfuryl acrylate, benzyl acrylate, bis(4-acryloxypolyethoxyphenyl)propane, neopentylglycol diacrylate, 1,6-hexanediol diacrylate, ethylene glycol diacrylate, diethylene glycol diacrylate, triethylene glycol diacrylate, tetraethylene glycol diacrylate, polyethylene glycol diacrylate, polypropylene glycol diacrylate, pentaerythritol triacrylate, pentaerythritol tetraacrylate, dipentaerythritol tetraacrylate, trimethylolpropane triacrylate, tetramethylolmethane tetraacrylate, oligoester acrylate, N-methylol acrylamide, diacetone acrylamide, or epoxy acrylate; and methacrylic acid derivatives such as methyl methacrylate, n-butyl methacrylate, 2-ethylhexyl methacrylate, lauryl methacrylate, allyl methacrylate, glycidyl methacrylate, benzyl methacrylate, dimethylaminomethyl methacrylate, 1,6-hexanediol dimethacrylate, ethylene glycol dimethacrylate, triethylene glycol dimethacrylate, polyethylene glycol dimethacrylate, polypropylene glycol dimethacrylate, trimethylolethane trimethacrylate, trimethylolpropane trimethacrylate, or 2,2-bis(4-methacryloxypolyethoxyphenyl) propane; as well as allyl compound derivatives such as allyl glycidyl ether, diallyl phthalate, or triallyl trimellitate. Further, there are usable radically polymerizable and cross-linkable monomers, oligomers, and polymers commercially available or known in the art described, specifically, in "Kakyozai Handbook (Handbook of Crosslinking Agents)," edited by Shinzo Yamashita (1981, Taisei Sha); "UV EB Kohka Handbook (Genryo Hen) (UV-EB Curing Handbook (Raw Materials Part)," edited by Kiyoshi Kato (1985, Kohbunshi Kankoh Kai); "UV-EB Kohka Gijutsu no Ohyoh to Shijoh (Application and Market of UV•EB Curing Technology)", edited by Rad Tech Japan, page 79 (1989, CMC); and Eiichiroh Takiyama, "Polyester Jushi Handbook (Handbook of Polyester Resins)" (1988, Nikkan Kogyo Shimbun Ltd.). The amount of any of the above radically polymerizable compounds added is preferably 1-97% by mass, more preferably 30-95% by mass.

[Photo Initiator]

<Radical Polymerization Initiators>

As radical polymerization initiators, there are listed triazine derivatives described in JP-B Nos. 59-1281 and 61-9621 and JP-A 60-60104; organic peroxides described in JP-A Nos. 59-1504 and 61-243807; diazonium compounds described in JP-B Nos. 43-23684, 44-6413, 44-6413, and 47-1604, and U.S. Pat. No. 3,567,453 specification; organic azide compounds described in U.S. Pat. Nos. 2,848,328, 2,852,379, and 2,940,853 specifications; ortho-quinonediazides described in JP-B Nos. 36-22062, 37-13109, 38-18015, and 45-9610; various kinds of onium compounds described in JP-B 55-39162, JP-A 59-14023, and "Macromolecules," Vol. 10, page 1307 (1977); azo compounds described in JP-A 59-142205; metal allene complexes described in JP-A 1-54440, European Patent Nos. 109,851 and 126,712, and "J. Imag. Sci.," Vol. 30, page 174 (1986); (oxo)sulfonium organic boron complexes described in JP-A Nos. 4-213861 and 4-255347; titanocenes described in JP-A 61-151197; transition metal complexes containing a transition metal such as ruthenium described in "Coordination Chemistry Review," Vol. 84, pages 85-277 (1988) and JP-A 2-182701; 2,4,5-triarylimidazole dimers and carbon tetrabromide described in JP-A 3-209477; and organic halogen compounds described in JP-A 59-107344. Any of these radical polymerization initiators is preferably contained in the range of 0.01-10 parts by mass, based on 100 parts by mass of a compound having a radically polymerizable ethylenically-unsaturated bond.

These initiators are exemplified as follows:

1) benzophenones such as benzophenone, hydroxybenzophenone, bis-N,N-dimethylaminobenzophenone, bis-N,N-diethylaminobenzophenone, or 4-methoxy-4'-dimethylaminobenzophenone, and salts thereof;

2) thioxanthones such as thioxanthone, 2,4-diethylthioxanthone, isopropylthioxanthone, chlorothioxanthone, or isopropoxychlorothioxanthone, and salts thereof;

3) anthraquinones such as ethylanthraquinone, benzanthraquinone, aminoanthraquinone, or chloroanthraquinone;

4) acetophenones;

5) benzoin ethers such as benzoin methyl ether;

6) 2,4,6-trihalomethyltriazines;

7) imidazoles such as 1-hydroxycyclohexyl phenyl ketone, imidazoles such as 2-(o-chlorophenyl)-4,5-diphenylimidazole dimers, 2-(o-chlorophenyl)-4,5-di(m-methoxyphenyl) imidazole dimers, 2-(o-fluorophenyl)-4,5-phenylimidazole dimers, 2-(o-methoxyphenyl)-4,5-phenylimidazole dimers, 2-(p-methoxyphenyl)-4,5-diphenylimidazole dimers, 2-di(p-methoxyphenyl)-5-phenylimidazole dimers, 2-(2,4-dimethoxyphenyl)-4,5-diphenylimidazole dimers, or 2,4,5-triarylimidazole dimers;

8) benzoins such as benzyldimethylketal, 2-benzyl-2-dimethylamino-1-(4-morpholinophenyl)butane-1-one, 2-methyl-1-[4-(methylthio)phenyl]-2-morpholino-1-propanone, 2-hydroxy-2-methyl-1-phenyl-propane-1-one, 1-[4-(2-hydroxyethoxy)-phenyl]-2-hydroxy-2-methyl-1-propane-1-one, phenanthrenequinone, 9,10-phenanthrenequinone, and benzoins such as methylbenzoin or ethylbenzoin;

9) acridine derivatives such as 9-phenylacridine or 1,7-bis (9,9'-acridinyl)heptane;

10) bisacylphosphine oxide, bisphenylphosphine oxide, and bis(2,4,6-trimethylbenzoil)-phenylphosphine oxide; and 11) 4-(2-hydroxyethoxy)phenyl-(2-hydroxy-2-propyl)ketone and ethylene oxides thereof.

Further, the above initiators may be added to the ink in the form of a dissolved material or a dispersed material, as appropriate.

A photosensitizer may be used in the ink of the invention. Examples of the photosensitizers include ethyl p-dimethylaminobenzoate, isoamyl p-dimethylaminobenzoate, ethanolamine, diethanolamine, and triethanolamine.

(Cationic Photopolymerization Initiator)

Cationic photopolymerization initiator according to the invention is preferred as cationic photopolymerization initiator having a content of cationic compound, metal compound and strong acidic compound in the range from 1 ppm or more to 500 ppm or less.

Examples of the cationic photopolymerization initiator used in the invention include well-known sulfonium salt, ammonium salt, diaryliodonium salt, triarylsulfonium salt, and for example, can be selected appropriately from one described in JP-A Nos. 8-143806 and 8-283320. Further, a product of the cationic photopolymerization initiator on the market can be usable as it is. Specific example of product on the market include CI-1370, CI-2064, CI-2397, CI-2624, CI-2639, CI-2734, CI-2758, CI-2823, CI-2855 and CI-5102 (Product of Nippon Soda), PHOTOINITIATOR2047 (Rhodia) and WI-6974 and UVI-6990 (product of Union Carbide).

The cationic photopolymerization initiator content varies with species of initiator; species, ratio and condition of cationic polymerizable compound. Content is generally from 0.1 to 20 parts by weight, preferably 1 to 10 parts by weight, more preferably 3 to 5 parts by weight, based on 100 parts by weight of a cationic polymerizable compound in the cationic polymerizable composition. The content exceeding a range above provides faster polymerization but exhibits poor storage stability, and content lowering a range above exhibit a poor hardening property.

[Gelling Agent]

Next, a gelling agent used in the ink of the present invention will be described.

Gel according to the present invention refers to a collective structure of solute by loosing independent mobility as a result of an interaction such as a lamella structure, a polymer network with a covalent bond or a hydrogen bond, a polymer network formed by a physical coagulation, and a coagulation structure of fine particles, and a state of solidification or half-solidification accompanied by a rapid viscosity increasing or a remarkable elasticity increasing.

Generally, gel comprises a heat reversible gel which converts to a solution having fluidity (referred to as a sol) by heating and returns to an original gel by cooling, and a heat irreversible gel which cannot return to a solution after gelling by heating. The gel formed by oil gelling agent relating to the invention is preferably a heat reversible gel in view of preventing head clogging.

According to the invention, a gelling temperature (a phase transfer temperature) of an ink is preferable 40° C. or more and 80° C. or less, more preferably 45° C. or more and 70° C. or less. In consideration of an atmosphere temperature in summer, in a case that ink has a phase transfer temperature of 40° C. or more, stable ink ejection can be obtained without depending on a temperature of printing circumstances. In case that ink has a phase transfer temperature of 80° C. or less, it is not necessary to heat an inkjet recording apparatus to an excess high temperature and this can reduce a load to a head of inkjet recording apparatus or a material of an ink supply system.

The phase transfer temperature by sol-gel relating to the invention means the temperature at which a viscosity changes rapidly from a fluid solution state to a gel state and synonymous with a gel transfer temperature, a gel soluble temperature, a gelling temperature, a sol-gel transfer temperature and a gel point.

The measurement of a phase transfer temperature of ink relating to the invention includes, for example, a method which defines as follows. A small iron piece fused into a glass tube is put into a diatometer and a temperature of an ink is changed. A temperature when this iron piece stops a gravity fall in ink liquid is defined as the phase transfer temperature (J. Polym. Sci., 21, 57 (1956)), and a method which measures a temperature when a aluminum cylinder located on a gel ink starts to gravity fall by changing a temperature of a gel (Japan Rheology Gakkaishi Vol. 17, 86 (1989)). Further, as a simple method, a gel-like test piece is located on a heat plate, and a temperature when a shape of test-piece is destroyed by heating on a heat plate is observed and defined as a sol-gel transfer temperature.

A gelling agent used to the ink of the invention may be a polymer compound or a low molecular compound. In view of using in an ink, a low molecular compound is preferred. Further, as a gel structure, preferred is a compound which can form a fiber-like association by an oil gelling agent itself. Formation of a fiber-like association can be observed easily by a shape observation by a transmission electron microscope. Specific compound is described, for example, in JP-A Nos. 2005-126507 and 2006-193745. Among them, preferred is a compound which has a hydrophobic part such as at least two long alkyl group or phenyl group sandwiching a polar group in molecule and has capability to form two or more hydrophobic bonds, or a compound which has a structure having capability of hydrogen bond such as at least two hydroxyl groups, amide groups, carbon acid groups, ether groups, and amide groups sandwiching a hydrophobic part such as a long alkyl group or a phenyl group. Because it is capable to form gel in a small amount, it results in advantage in an ink performance such that a photo cure is less inhibited.

Specific example of gelling agent usable in ink relating to the invention is described below, however the compound of the invention is not limited thereto.

OG-1

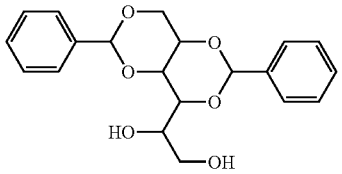

OG-2

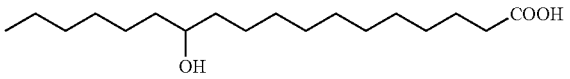

OG-3

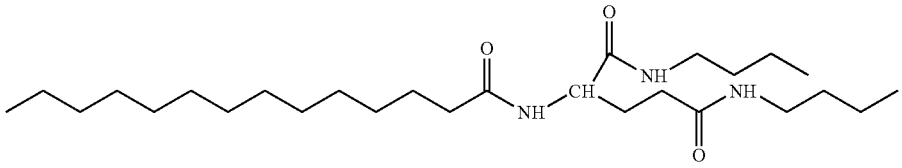

-continued
OG-4
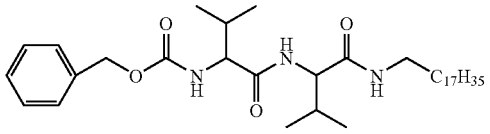
OG-5
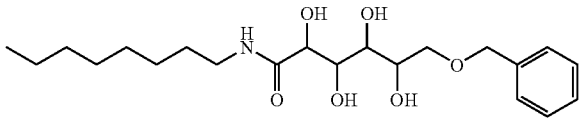
OG-6
$F(CF_2)_n(CH_2)_mH$
OG-7
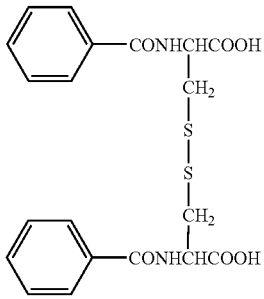
OG-8
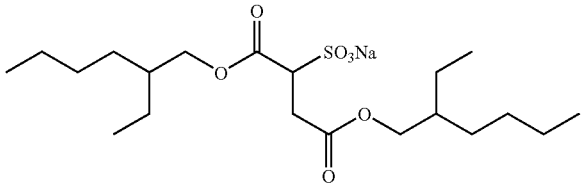
OG-9
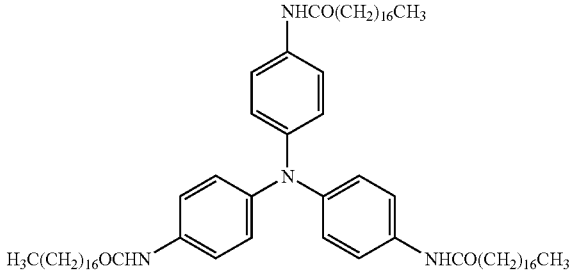
OG-10
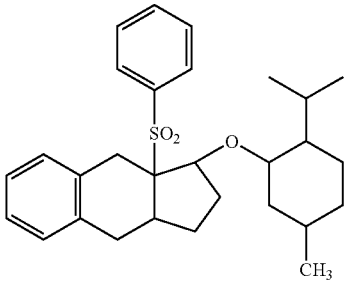
OG-11
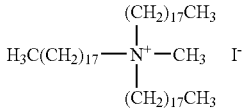
OG-12
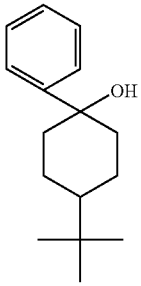
OG-13
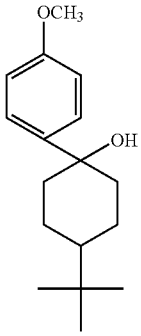

-continued

OG-14

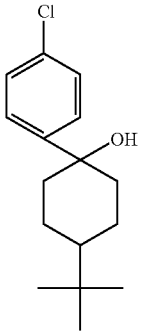

OG-15

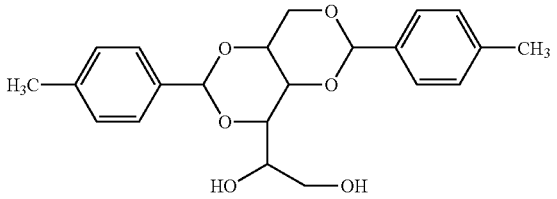

In view of above, preferable compound in exemplified gelling agent above includes OG-1, OG-2, OG-3, OG-4, OG-5, OG-9 and OG-15.

Waxes are usable as gelling agent in the invention. Specific example include a petroleum wax, preferably petrolatum; a plant wax, preferably candelira wax, carnauba wax, rice wax, vegetable wax or jojoba oil, and jojoba solid wax; an animal wax, preferably beewax, lanolin or whale wax; a mineral wax, preferably montan wax; a hydrogenated wax, preferably castor oil or castor oil derivatives; an denatured wax, preferably montan wax derivatives, paraffin wax derivatives, microcrystalline wax derivatives or polyethylene wax derivatives; a higher fatty acid, preferably behenic acid, stearic acid, palmitic acid, myristic acid, lauric acid or oleic acid; a higher alcohol, preferably stearyl alcohol or behenyl alcohol; a hydroxyl stearic acid, preferably 12-hydroxyl stearic acid or 12-hydroxyl stearic acid derivatives; an fatty acid amide, preferably lauric acid amide, stearic acid amide, oleic acid amide, eruca acid amide, lecinol acid amide, 12-hydroxy stearic acid amide, specific fatty acid amide or N-substituted fatty acid amide; an amine, preferably dodecylamine, tetradecylamine or octadecylamine; an ester, preferably glycerine fatty acid ester, ethyleneglycol fatty acid ester or polyoxyethylene fatty acid ester; a polymerized wax, preferably α-olefin-maleic anhydride copolymer wax. Waxes described above may be used alone or in combination of 2 or more species. Waxes described above exhibit slower gelling speed than gelling agent. Therefore gelling agent is preferably used.

Content of gelling agent is from 0.1 to 30 by weight, preferably 0.3 to 15% by weight, more preferably 3 to 15 by weight, weight, based on 100% by weight of an ink. The content of gelling agent within the range of 0.3 to 15% by weight exhibit more stable ejecting properties, and produce more effects of the invention. Especially in the case of using a pigment as a colorant, content of gelling agent is preferably kept in the range of 0.3 to 15% by weight, because gelling agent tend to break dispersion stability.

[Other Additives]

Various additives other than described above may be usable in the ink according to the invention. Specific example of additives include a surfactant, a leveling agent, a matting agent, a polyester type resin for controlling film properties, a polyurethane resin, a vinyl resin, an acryl resin, a rubber resin, and waxes. Further, so as to improve storage stability and sensitivity, a basic organic compound such as a basic alkali metal compound, a basic alkali-earth metal compound and amine are usable. A hybrid type curable ink comprising radical and cationic is also usable.

<<Recording Mediums>>

There can be employed a variety of recording media in the image forming apparatus of the invention without limitation. Specific example include a paper based recording medium such as a plain paper used in copy, an art paper, a conventional non-coated paper, a coated paper both face coated by resin, and non-absorptive plastics and their films used in soft packaging. Examples of plastic film include polyethylene terephthalate (PET) film, stretched polystyrene (OPS) film, stretched polypropylene (OPP) film, stretched nylon (ONy) film, polyvinyl chloride (PVC) film, polyethylene (PE) film, and triacetyl cellulose (TAC) film. Other plastics include polycarbonate, acryl resin, ABS, polyacetal, polyvinyl alcohol (PVA), and various rubbers. Further, metals and glass are also feasible.

EXAMPLES

The present invention will now specifically be described with reference to examples that by no means limit the scope of the present invention. Herein, the designation "part" or "%" in the examples represents "part by mass" or "% by mass" unless otherwise specified.

Example 1

Preparation of Ink Set

| [Preparation of Ink set 1: Radical polymerizable Ink, Free from gelling agent] (Preparation of Pigment dispersion liquid) (Preparation of Yellow pigment dispersion liquid 1) | |
|---|---|
| Dispersant: Polymer dispersant Solsperse 17000 (product of Avecia) | 10 parts |
| 1,6-Hexanediol dimethacrylate | 70 parts |

Each compound above was put into a stainless beaker and was stirred and solved by heating 1 hour on a hot plate at 65° C. Then, after cooling down to a room temperature, 20 parts of pigment below was added and was put into glass bottle with 200 g of zirconium beads having 0.5 mm diameter and sealed. After dispersing it 10 hours by paint shaker, zirconium beads were removed and Yellow pigment dispersion liquid 1 was prepared.

Pigment: C.I. Pigment Yellow 128

(Preparation of Magenta Pigment Dispersion Liquid 1)

Magenta pigment dispersion liquid 1 was prepared as same manner as the preparation of Yellow pigment dispersion liquid 1, except for replacing C.I. Pigment Yellow 128 to C.I. Pigment Red 122.

(Preparation of Cyan Pigment Dispersion Liquid 1)

Cyan pigment dispersion liquid 1 was prepared as same manner as the preparation of Yellow pigment dispersion liquid 1, except for replacing C.I. Pigment Yellow 128 to C.I. Pigment Blue 15:3.

(Preparation of Black Pigment Dispersion Liquid 1)

Black pigment dispersion liquid 1 was prepared as same manner as the preparation of Yellow pigment dispersion liquid 1, except for replacing C.I. Pigment Yellow 128 to carbon black.

(Preparation of Ink)

According to the method below, Yellow ink 1, Magenta ink 1, Cyan ink 1 and Black ink. 1 were prepared and referred to as Ink set 1.

| (Preparation of Yellow ink 1) | |
|---|---|
| Yellow pigment dispersion liquid 1 | 15 parts |
| Trimethylolpropane triacrylate | 35 parts |
| 1,6-Hexanediol dimethacrylate | 20 parts |
| N-vinyl caprolactam | 20 parts |
| Norbornene acrylate | 5 parts |
| Irgacure 651: photo initiator (product by Ciba Japan) | 3 parts |
| Irgacure 127: photo initiator (product by Ciba Japan) | 2 parts |

Each compound above was added and mixed in this order. Then it was filtered by filter with absolute filtration accuracy of 2 μm and Yellow ink 1 was prepared.

(Preparation of Magenta Ink 1)

Magenta ink 1 was prepared as same manner as the preparation of Yellow ink 1, except for replacing Yellow pigment dispersion liquid 1 (C.I. Pigment Yellow 128) to Magenta pigment dispersion liquid 1 (C.I. Pigment Red 122).

(Preparation of Cyan Ink 1)

Cyan ink 1 was prepared as same manner as the preparation of Yellow ink 1, except for replacing Yellow pigment dispersion liquid 1 (C.I. Pigment Yellow 128) to Cyan pigment dispersion liquid 1 (C.I. Pigment Blue 15:3), replacing content of Irgacure 651 to 2 parts, and further replacing content of Irgacure 127 to 3 parts.

(Preparation of Black Ink 1)

Black ink 1 was prepared as same manner as the preparation of Cyan ink 1, except for replacing Cyan pigment dispersion liquid 1 (C.I. Pigment Blue 15:3) to Black pigment dispersion liquid 1 (Carbon black).

[Preparation of Ink Set 2: Radical Polymerizable Ink]

According to the method below, Yellow ink 2, Magenta ink 2, Cyan ink 2 and Black ink 2 were prepared and referred to as Ink set 2.

Yellow ink 2, Magenta ink 2, Cyan ink 2 and Black ink 2 were prepared by the same manner as the preparation of Yellow ink 1, Magenta ink 1, Cyan ink 1 and Black ink 1, except for changing the content of 1,6-hexanediol dimethacrylate from 20 parts to 13 parts, using 7 parts of the exemplified compound OG-5 as gelling agent, adding and mixing each additives in that order, heating and stirring at 80° C., filtering the liquid through metal mesh filter #3000 under heating and cooling down to ink.

Gelling temperature of above inks of each color were 70° C. according to an evaluation method below.

A test piece of each gel-like ink was placed on a melting point measurement apparatus (ATM-01, manufactured by AS ONE Corporation), and a temperature at which a test piece was melted was evaluated by heating with temperature elevating speed 5° C./minute or less. Gelling temperature of this ink was calculated by averaging evaluation data of repeating 3 times, and rounding the average to one decimal place.

<<Image Formation>>

[Formation of Image 101]

Image 101 was formed according to conditions below by using a scan type printer shown in FIG. 1. Piezo head 2 having 25 μm of nozzle diameter, 12 kHz of driving frequency, 128 of nozzle numbers, 180 dpi of nozzle density (herein dpi represents a number of dots per 2.54 cm) was used and UV light source 3 was fixed at a downstream of head 2 so as to cover full width of recording media 4.

From a piezo head 2, Ink set 2 which were prepared above and kept warm at 90° C. (+20° C. higher than an ink gelling temperature of 70° C.) were ejected on the polyethylene film of 80 μm thickness which was kept warm at 60° C. by a panel heater arranged at back side of the recording medium and the surface of which was treated by corona discharge. Then ink droplets were fixed by gelling. After that, radiation was carried out by radiation light source A (low pressure mercury-vapor lamp G64T5L (manufactured by Sankyo Denki) which were located at the downstream of the carriage. Ultra-violet ray was exposed 1 second under the condition of illuminance 10 mW/cm2 by arranging a radiation position (height) and ink was cured. Precise color digital standard image data "Fruits Basket" issued by Incorporated Foundation Nippon Kikaku Kyoukai was obtained in A4 size. Image 101 was formed under the circumstances of 23° C., 55% RH.

[Formation of Images 102 to 136]

Images 102 to 136 were prepared in the same manner as the formation of Image 101, except for replacing species of ink set, temperature of ink, temperature of recording medium and radiation conditions (species of light source, illuminance and radiation time) according to combinations described in Table 1.

Image forming conditions and irradiation light source of Images 102 to 136 are detailed below.

(Irradiation Light Source)

Irradiation light source A: Low pressure mercury-vapor lamp G64T5L (manufactured by Sankyo Denki) Peak wavelength=254 nm Irradiation light source B: UV-B lamp GL40SE (manufactured by Sankyo Denki) Peak wavelength-310 nm Irradiation light source C: LED (manufactured by Nichia Corporation, custom-made) Peak wavelength=365 nm (Control of Illuminance)

Position of irradiation for each irradiation light source was adjusted so as to satisfy illuminance described in Table 1.

(Irradiation Time)

For illuminance in 0.08 nW/cm2 to 10 mW/cm2, irradiation time was adjusted so as to keep 10 mJ/cm2 of a intensity of irradiation. For more illuminance, irradiation time was adjusted to 1 second.

(Temperature Control of Ink Set)

Temperatures of ink sets and inkjet heads were controlled as temperature described in Table 1.

(Surface Temperature of Recording Medium)

Surface temperature of recording medium was controlled by a panel heater placed on back side of recording medium as temperature described in Table 1.

<<Image Evaluation>>

Each image formed by the methods above was evaluated in each property below.

(Ink Ejection Stability)

Figure 1:
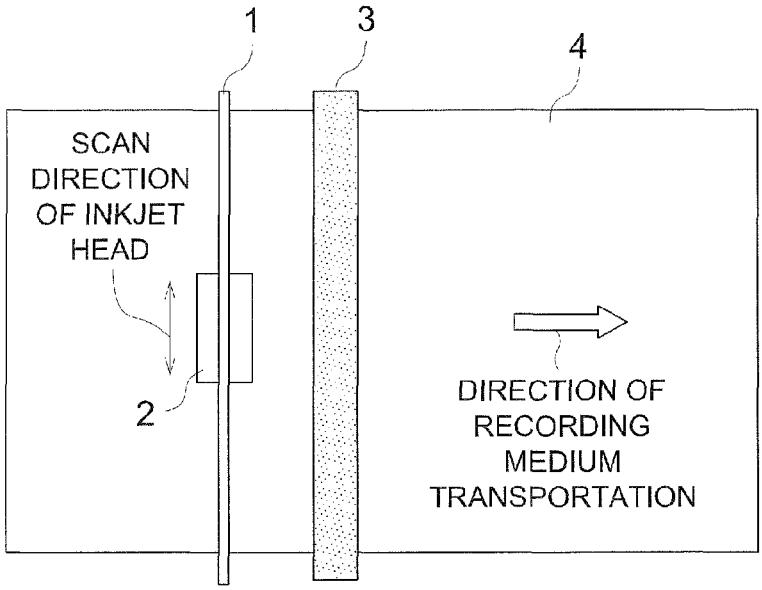
FIG. 1 is a schematic view showing the constitution of the scan type printer used in EXAMPLES.

By using scan type printer shown in FIG. 1, image of black ink with duty 100% was printed and shape and size of dots were measured by loupe. The ink ejection stability was evaluated based on the following criteria.

A. More than 90% of dot sizes were within ±20% of the average dot size.

B: More than 60% of dot sizes were within ±40% of the average dot size.

C: All dots could be observed but sizes were unequal.

D: Several dots were missing and nozzle clogging was observed in some nozzles.

(Evaluation of Bleed Resistance)

Boundary line between apple and black background in Fruits Basket image obtained by the method above was visually observed and the bleed resistance was evaluated based on the following criteria.

A: The boundary line was clear.

B: Slight bleeding was observed in the boundary portion but the resultant quality fell within the limit of commercial viability.

C: Bleeding was observed in the boundary portion but the resultant quality fell within the limit of commercial viability.

D: Bleeding was clearly observed in the boundary portion and the line width was increased 1.5 times, resulting in problematic quality for commercial viability.

E: The boundary line was unclear and bleed resistance was extremely poor.

[Evaluation of Abrasion Resistance]

Surface of Fruits Basket image formed on a polyethylene film was rubbed by Kimwipe S-200 (product of Crecia) and the degradation of image density was visually observed, averaged a result of each inks and the abrasion resistance was evaluated based on the following criteria.

A: Change of image could not be observed after repeating rubbing 101 times.

B: Slight scratch was observed after repeating rubbing 100 times but it slightly affected on image density.

C: Lowering of image density was observed during rubbing 75 to 99 times but the resultant quality fell within the limit of commercial viability.

D: Lowering of image density was observed during rubbing 50 to 74 times.

E: Lowering of image density was clearly observed during rubbing 50 times or less and resulting in problematic quality for commercial viability.

[Evaluation of Stickiness Resistance]

Stickiness of surface of each solid image was observed by finger touching and the stickiness resistance were evaluated based on the following criteria.

A: Stickiness of image could not be observed.

B: Slight stickiness was observed in a part of color ink.

C: Slight stickiness was observed in all color inks but the resultant quality fell within the limit of commercial viability.

D: Stickiness was observed in all color inks, and resulting in problematic quality for commercial viability.

E: Strong stickiness was observed in all colored inks, and resulting in problematic quality for practically viability.

[Evaluation of Adhesion]

Grid test based on JIS K 5400 were prepared. With respect to the above-prepared printed solid images, 11 lines of length and breadth notches were formed on the printed surface at an angle of 90 degree at 1 mm intervals to form 100 grids of 1 mm square, Celotape (registered mark) being pasted up on each printed surface, being quickly peeled off, and the state of printed images or grids remained without peeling was evaluated based on the following criteria.

A: No peeling-off is observed in the grid test.

B: Ratio of area for peeling-off is 5% or less.

C: Ratio of area for peeling-off is 5% or more and 10% or less.

D: Ratio of area for peeling-off is 10% or more and 20% or less.

E: Ratio of area for peeling-off is 20% or more.

Results obtained above evaluation were shown in Table 1.

TABLE 1

| | | | Radiation | Radiation conditions | | |
|---|---|---|---|---|---|---|
| No. of Image | No. of Ink set | Temperature of Ink (° C.) | conditions (° C.) | Radiation light source | Illuminance (mW/cm$^2$) | Radiation time (second) |
| 101 | 2 | 90 | 60 | A | 10.0 | 1.0 |
| 102 | 2 | 80 | 60 | A | 10.0 | 1.0 |
| 103 | 2 | 75 | 65 | A | 10.0 | 1.0 |
| 104 | 2 | 70 | 70 | A | 10.0 | 1.0 |
| 105 | 2 | 80 | 70 | A | 10.0 | 1.0 |
| 106 | 2 | 80 | 65 | A | 10.0 | 1.0 |
| 107 | 2 | 75 | 60 | A | 10.0 | 1.0 |
| 108 | 2 | 80 | 35 | A | 10.0 | 1.0 |
| 109 | 2 | 80 | 30 | A | 10.0 | 1.0 |
| 110 | 2 | 80 | 5 | A | 10.0 | 1.0 |
| 111 | 2 | 80 | 0 | A | 10.0 | 1.0 |
| 112 | 1 | 80 | 60 | A | 10.0 | 1.0 |
| 113 | 2 | 80 | 60 | A | 0.08 | 125 |
| 114 | 2 | 80 | 60 | A | 0.1 | 100 |
| 115 | 2 | 80 | 60 | A | 1.0 | 10 |
| 116 | 2 | 80 | 60 | A | 3.0 | 3.3 |
| 117 | 2 | 80 | 60 | A | 20.0 | 1.0 |
| 118 | 2 | 80 | 60 | A | 30.0 | 1.0 |
| 119 | 2 | 80 | 60 | A | 30.0 | 1.0 |
| 120 | 2 | 80 | 60 | A | 50.0 | 1.0 |
| 121 | 2 | 80 | 60 | A | 70.0 | 1.0 |

| | Evaluation results | | | | | |
|---|---|---|---|---|---|---|
| No. of Image | Ink jettability | Bleed resistance | Abrasion resistance | Stickiness resistance | Adhesion to recording media | Remarks |
| 101 | A | A | A | A | A | Present invention |
| 102 | A | A | A | A | A | Present invention |

TABLE 1-continued

| | | | | | | |
|---|---|---|---|---|---|---|
| 103 | B | A | A | A | A | Present invention |
| 104 | D | — | — | — | — | Comparative example |
| 105 | A | E | A | A | A | Comparative example |
| 106 | A | B | A | A | A | Present invention |
| 107 | B | A | A | A | A | Present invention |
| 108 | A | A | A | A | A | Present invention |
| 109 | A | A | B | A | B | Present invention |
| 110 | A | A | C | A | C | Present invention |
| 111 | A | A | C | A | C | Present invention |
| 112 | A | E | D | C | C | Comparative example |
| 113 | A | D | E | D | E | Comparative example |
| 114 | A | C | C | C | C | Comparative example |
| 115 | A | C | B | B | B | Present invention |
| 116 | A | B | B | B | C | Present invention |
| 117 | A | A | A | A | A | Present invention |
| 118 | A | B | B | B | B | Present invention |
| 119 | A | B | B | B | B | Present invention |
| 120 | A | A | B | C | C | Present invention |
| 121 | A | A | C | D | D | Comparative example |

| | | | Radiation | Radiation conditions | | |
|---|---|---|---|---|---|---|
| No. of Image | No. of Ink set | Temperature of Ink (° C.) | conditions (° C.) | Radiation light source | Illuminance (mW/cm$^2$) | Radiation time (second) |
| 122 | 2 | 80 | 60 | A | 70.0 | 1.0 |
| 123 | 2 | 80 | 60 | B | 0.08 | 125 |
| 124 | 2 | 80 | 60 | B | 0.1 | 100 |
| 125 | 2 | 80 | 70 | B | 1.0 | 10 |
| 126 | 2 | 80 | 60 | B | 1.0 | 10 |
| 127 | 2 | 80 | 20 | B | 1.0 | 10 |
| 128 | 2 | 80 | 60 | B | 1.0 | 1.0 |
| 129 | 2 | 80 | 60 | B | 30.0 | 1.0 |
| 130 | 2 | 80 | 60 | B | 50.0 | 1.0 |
| 131 | 2 | 80 | 60 | B | 70.0 | 1.0 |
| 132 | 2 | 80 | 20 | B | 70.0 | 1.0 |
| 133 | 2 | 80 | 60 | C | 0.08 | 125 |
| 134 | 2 | 80 | 60 | C | 0.1 | 100 |
| 135 | 2 | 80 | 60 | C | 1.0 | 10 |
| 136 | 2 | 80 | 60 | C | 3.0 | 3.3 |
| 137 | 2 | 80 | 60 | C | 10.0 | 1.0 |
| 138 | 2 | 80 | 60 | C | 30.0 | 1.0 |
| 139 | 2 | 80 | 60 | C | 50.0 | 1.0 |
| 140 | 2 | 80 | 60 | C | 70.0 | 1.0 |

| | Evaluation results | | | | | |
|---|---|---|---|---|---|---|
| No. of Image | Ink jettability | Bleed resistance | Abrasion resistance | Stickiness resistance | Adhesion to recording media | Remarks |
| 122 | A | A | D | E | E | Comparative example |
| 123 | A | E | D | E | D | Comparative example |
| 124 | A | C | C | C | C | Comparative example |
| 125 | A | D | B | B | C | Comparative example |
| 126 | A | B | B | B | C | Present invention |
| 127 | A | C | C | B | C | Present invention |
| 128 | A | A | A | B | A | Present invention |
| 129 | A | A | B | B | B | Present invention |
| 130 | A | A | B | C | C | Present invention |
| 131 | A | B | D | D | D | Comparative example |
| 132 | A | C | D | D | D | Comparative example |
| 133 | A | E | D | E | E | Comparative example |
| 134 | A | C | C | C | C | Comparative example |
| 135 | A | C | B | C | B | Present invention |
| 136 | A | C | B | B | C | Present invention |
| 137 | A | B | B | B | B | Present invention |
| 138 | A | B | C | B | B | Present invention |
| 139 | A | B | C | C | C | Present invention |
| 140 | A | B | D | D | D | Comparative example |

AS clearly shown in the results of Table 1, it was found that the image formed by using the ink and by the radiation under the condition according to the invention exhibit excellent bleed resistance, abrasion resistance, stickiness resistance and higher adhesion to the recording medium.

By changing the recording medium in forming images 101 to 136 above from polyethylene film to PET (polyethylene terephthalate) film, OPS (stretched polyethylene) film, OPP (stretched polypropylene) film, ONy (stretched Nylon) film, PVC (poly vinylchloride) film, and TAC (triacetyl cellulose)

film, the same properties were evaluated. As the result, the images formed by the image forming apparatus of the invention exhibit excellent result as well as the result described in Table 1.

Example 2

Preparation of Ink Set

[Preparation of Ink Set 3: Radical Polymerizable Ink]

According to the method below, Yellow ink 3, Magenta ink 3, Cyan ink 3 and Black ink 3 were prepared and referred to as Ink set 3.

(Preparation of Each Color Ink)

yellow ink 3, magenta ink 3, cyan ink 3 and black ink 3 were prepared by the same manner as the preparation of Yellow ink 2, Magenta ink 2, Cyan ink 2 and Black ink 2 described in Example 1, except for changing the exemplified compound OG-5 as the gelling agent to the same content of exemplified compound OG-2.

Gelling temperature of above inks of each color were 45° C. according to an evaluation method below.

<<Image Formation>>

[Formation of Images 201 to 218]

Images 201 to 218 were prepared in the same manner as the formation of Image 101 described in Example 1, except for replacing species of ink set (using ink set 3), temperature of ink, temperature of recording medium and irradiation conditions (species of light source, illuminance and radiation time) to combinations described in Table 2.

<<Image Evaluation>>

Each image above was evaluated in ink ejection, bleed resistance, abrasion resistance, stickiness resistance and higher adhesion to the recording medium in the same manner as described in Example 1. Results are shown in Table 2.

TABLE 2

| No. of Image | No. of Ink set | Temperature of Ink (° C.) | Radiation conditions (° C.) | Radiation conditions: Radiation light source | Radiation conditions: Illuminance (mW/cm$^2$) | Radiation conditions: Radiation time (second) |
|---|---|---|---|---|---|---|
| 201 | 3 | 70 | 35 | A | 10.0 | 1.0 |
| 202 | 3 | 60 | 40 | A | 10.0 | 1.0 |
| 203 | 3 | 55 | 40 | A | 10.0 | 1.0 |
| 204 | 3 | 50 | 35 | A | 10.0 | 1.0 |
| 205 | 3 | 40 | 35 | A | 10.0 | 1.0 |
| 206 | 3 | 50 | 45 | A | 10.0 | 1.0 |
| 207 | 3 | 50 | 40 | A | 10.0 | 1.0 |
| 208 | 3 | 55 | 30 | A | 10.0 | 1.0 |
| 209 | 3 | 55 | 20 | A | 10.0 | 1.0 |
| 210 | 3 | 55 | 0 | A | 10.0 | 1.0 |
| 211 | 3 | 55 | 35 | A | 0.08 | 125 |
| 212 | 3 | 55 | 35 | A | 0.1 | 100 |
| 213 | 3 | 55 | 45 | A | 1.0 | 10 |
| 214 | 3 | 55 | 35 | A | 1.0 | 10 |
| 215 | 3 | 55 | 20 | A | 1.0 | 10 |
| 216 | 3 | 55 | 35 | A | 30.0 | 1.0 |
| 217 | 3 | 55 | 35 | A | 50.0 | 1.0 |
| 218 | 3 | 55 | 45 | A | 70.0 | 1.0 |
| 219 | 3 | 55 | 35 | A | 70.0 | 1.0 |
| 220 | 3 | 55 | 20 | A | 70.0 | 1.0 |
| 221 | 3 | 55 | 35 | B | 10.0 | 1.0 |
| 222 | 3 | 55 | 35 | C | 10.0 | 1.0 |

| No. of Image | Evaluation results: Ink jettability | Bleed resistance | Abrasion resistance | Stickiness resistance | Adhesion to recording media | Remarks |
|---|---|---|---|---|---|---|
| 201 | A | A | A | A | A | Present invention |
| 202 | A | B | A | A | A | Present invention |
| 203 | A | B | A | A | A | Present invention |
| 204 | B | A | A | A | A | Present invention |
| 205 | E | — | — | — | — | Comparative example |
| 206 | B | E | A | A | A | Comparative example |
| 207 | B | B | A | A | A | Present invention |
| 208 | A | A | A | A | A | Present invention |
| 209 | A | A | B | A | B | Present invention |
| 210 | A | A | C | A | C | Present invention |
| 211 | A | D | E | D | E | Comparative example |
| 212 | A | C | C | C | C | Comparative example |
| 213 | A | E | B | B | C | Comparative example |
| 214 | A | B | B | B | C | Present invention |
| 215 | A | C | C | B | C | Present invention |
| 216 | A | B | A | A | B | Present invention |
| 217 | A | A | B | C | C | Present invention |
| 218 | A | D | C | D | D | Comparative example |
| 219 | A | A | C | D | D | Comparative example |
| 220 | A | A | D | D | D | Comparative example |
| 221 | A | A | A | B | A | Present invention |
| 222 | A | B | B | B | B | Present invention |

AS clearly shown in the results of Table 2, it was found that the images formed by using the inks (radical polymerizable inks) and by the irradiation under the condition according to the invention exhibit excellent bleed resistance, abrasion resistance, stickiness resistance and higher adhesion to the recording medium.

By changing the recording medium in forming images 201 to 218 above from polyethylene film to PET (polyethylene terephthalate) film, OPS (stretched polyethylene) film, OPP (stretched polypropylene) film, ONy (stretched Nylon) film, PVC (poly vinylchloride) film, and TAC (triacetyl cellulose) film, the same properties were evaluated. As the result, the images formed by the image forming apparatus of the invention exhibit excellent result as well as the result described in Table 2.

Example 3

Preparation of Ink Set

[Preparation of Ink Set 4: Cationic Polymerizable Ink]

(Preparation of Pigment Dispersion Liquids)

Yellow pigment dispersion liquid 2, Magenta pigment dispersion liquid 2, Cyan pigment dispersion liquid 2 and Black pigment dispersion liquid 2 were prepared in the same manner as the preparation of each pigment dispersion liquid in Ink set 1 described in Example 1 (Yellow pigment dispersion liquid 1, Magenta pigment dispersion liquid 1, Cyan pigment dispersion liquid and Black pigment dispersion liquid), except for replacing 1,6-hexanediol dimethacrylate to the same content of OXT221 (oxetane compound OXT221, product of Toa Gousei).

(Preparation of Inks)

According to the method below, Yellow ink 4, Magenta ink 4, Cyan ink 4 and Black ink 4 were prepared and referred to as Ink set 4.

| (Preparation of Yellow ink 4) | |
|---|---|
| Yellow pigment dispersion liquid 2 | 15 parts |
| Oxetane compound: OXT221 (product of Toa Gousei) | 48 parts |
| Epoxy soy oil: E4030 (product of Shin-nihon rika) | 25 parts |
| Photo initiator: Adeka optomer SP152 (product of Asahi Denka) | 5 parts |
| Gelling agent: Exemplified compound OG-1 | 7 parts |

Each additives above was added and mixed in that order, heated and stirred at 80° C., filtered the liquid through metal mesh filter #3000 under heating and cooled down to obtain Yellow ink 4.

(Preparation of Magenta Ink 4)

Magenta ink 4 was prepared in the same manner as the preparation of Yellow ink 4, except for replacing Yellow pigment dispersion liquid 2 (C.I. Pigment Yellow 128) to Magenta pigment dispersion liquid 2 (C.I. Pigment Red 122).

(Preparation of Cyan Ink 4)

Cyan ink 4 was prepared in the same manner as the preparation of Yellow ink 4, except for replacing Yellow pigment dispersion liquid 2 (C.I. Pigment Yellow 128) to Cyan pigment dispersion liquid 2 (C.I. Pigment Blue 15:3).

(Preparation of Black Ink 4)

Black ink 4 was prepared as same manner as the preparation of Yellow ink 4, except for replacing Yellow pigment dispersion liquid 2 (C.I. Pigment Yellow 128) to Black pigment dispersion liquid 4 (Carbon black).

Gelling temperature of above inks of each color were 61° C. according to an evaluation method above.

<<Image Formation>>

[Formation of Images 301 to 319]

Images. 301 to 319 were prepared in the same manner as the formation of Image 101 described in Example 1, except for replacing species of ink set (using ink set 3), temperature of ink, temperature of recording medium and irradiation conditions (species of light source, illuminance and radiation time) to combinations described in Table 3.

<<Image Evaluation>>

Each image above was evaluated in ink ejection, bleed resistance, abrasion resistance, stickiness resistance and higher adhesion to the recording medium in the same manner as Example 1. Results are shown in Table 3.

TABLE 3

| No. of Image | No. of Ink set | Temperature of Ink (° C.) | Radiation conditions (° C.) | Radiation conditions: Radiation light source | Radiation conditions: Illuminance (mW/cm$^2$) | Radiation conditions: Radiation time (second) |
|---|---|---|---|---|---|---|
| 301 | 4 | 71 | 56 | A | 0.08 | 125 |
| 302 | 4 | 71 | 56 | A | 0.1 | 100 |
| 303 | 4 | 71 | 56 | A | 1.0 | 10 |
| 304 | 4 | 71 | 56 | A | 3.0 | 3.3 |
| 305 | 4 | 90 | 56 | A | 10.0 | 1.0 |
| 306 | 4 | 71 | 50 | A | 10.0 | 1.0 |
| 307 | 4 | 66 | 56 | A | 10.0 | 1.0 |
| 308 | 4 | 61 | 56 | A | 10.0 | 1.0 |
| 309 | 4 | 66 | 56 | A | 10.0 | 1.0 |
| 310 | 4 | 71 | 61 | A | 10.0 | 1.0 |
| 311 | 4 | 71 | 51 | A | 10.0 | 1.0 |
| 312 | 4 | 66 | 30 | A | 10.0 | 1.0 |
| 313 | 4 | 71 | 5 | A | 10.0 | 1.0 |
| 314 | 4 | 71 | 0 | A | 10.0 | 1.0 |
| 315 | 4 | 71 | 56 | A | 30.0 | 1.0 |
| 316 | 4 | 71 | 56 | A | 50.0 | 1.0 |
| 317 | 4 | 71 | 56 | A | 70.0 | 1.0 |
| 318 | 4 | 71 | 56 | B | 1.0 | 10 |
| 319 | 4 | 71 | 56 | B | 10.0 | 1.0 |

TABLE 3-continued

| | | | | | | |
|---|---|---|---|---|---|---|
| 320 | 4 | 71 | 56 | C | 3.0 | 3.3 |
| 321 | 4 | 71 | 56 | C | 10.0 | 1.0 |

| | Evaluation results | | | | | |
|---|---|---|---|---|---|---|
| No. of Image | Ink jettability | Bleed resistance | Abrasion resistance | Stickiness resistance | Adhesion to recording media | Remarks |
| 301 | A | C | D | D | D | Comparative example |
| 302 | A | B | C | B | C | Comparative example |
| 303 | A | B | B | B | B | Present invention |
| 304 | A | B | B | B | A | Present invention |
| 305 | A | B | A | A | A | Present invention |
| 306 | A | A | A | A | A | Present invention |
| 307 | B | A | A | A | A | Present invention |
| 308 | D | — | A | — | — | Comparative example |
| 309 | B | A | A | A | A | Present invention |
| 310 | D | — | — | — | — | Comparative example |
| 311 | A | A | A | A | A | Present invention |
| 312 | B | A | A | A | A | Present invention |
| 313 | A | A | C | A | C | Present invention |
| 314 | A | A | C | A | C | Present invention |
| 315 | A | A | B | B | C | Present invention |
| 316 | A | A | C | C | C | Present invention |
| 317 | A | A | D | E | D | Comparative example |
| 318 | A | B | B | B | B | Present invention |
| 319 | A | A | A | A | A | Present invention |
| 320 | A | B | C | B | B | Present invention |
| 321 | A | B | A | B | B | Present invention |

AS clearly shown in the results of Table 3, it was found that the images formed by using the inks (cationic polymerizable inks) and by the irradiation under the condition according to the invention exhibit excellent bleed resistance, abrasion resistance, stickiness resistance and higher adhesion to the recording medium.

By changing the recording medium in forming images 301 to 319 above from polyethylene film to PET (polyethylene terephthalate) film OPS (stretched polyethylene) film, OPP (stretched polypropylene) film, ONy (stretched Nylon) film, PVC (poly vinylchloride) film, and TAC (triacetyl cellulose) film, the same properties were evaluated. As a result, the images formed by the image forming apparatus of the invention exhibit excellent results as well as the results described in Table 3.

What is claimed is:

1. An image forming apparatus for an inkjet recording method that forms an image by jetting a photo-radically curable inkjet ink comprising a colorant, a photo-curable monomer, a photo-radical initiator and a gelling agent onto a recording medium, and photo-radically curing the ink by a light irradiation apparatus, the image-forming apparatus comprising:

a warming section for warming the photo-radically curable inkjet ink at a warming temperature of 5 to 30° C. higher than a gelling temperature of the photo-radically curable inkjet ink, and a control section for controlling a surface of the recording medium at a surface temperature of 5 to 30° C. lower than the gelling temperature of the photo-radically curable inkjet ink, wherein an illuminance of the light irradiation apparatus is 1 mW/cm$^2$ or more and 30 mW/cm$^2$ or less in a radiation time of 10 seconds or less.

2. The image forming apparatus for an inkjet recording of claim 1, wherein the surface temperature of the recording medium is controlled at a temperature of 30° C. or higher and at 5 to 30° C. lower than the gelling temperature of the photo-curable inkjet ink.

3. The image forming apparatus for an inkjet recording of claim 1, wherein a peak wavelength of a light emitted from the light irradiation apparatus is in a range of 230 nm or more and 330 nm or less.

4. The image forming apparatus for an inkjet recording of claim 1, wherein the gelling temperature of the photo-curable inkjet ink is in a range of 40° C. or more and 80° C. or less.

5. An image forming apparatus for an inkjet recording method that forms an image by jetting a photo-radically curable inkjet ink comprising a colorant, a photo-curable monomer, a photo-radical initiator and a gelling agent onto a recording medium, and photo-radically curing the ink by a light irradiation apparatus, the image-forming apparatus comprising:

a warming section for warming the photo-radically curable inkjet ink at a warming temperature of 5 to 30° C. higher than a gelling temperature of the photo-radically curable inkjet ink, and a control section for controlling a surface of the recording medium at a surface temperature of 5 to 30° C. lower than the gelling temperature of the photo-radically curable inkjet ink, wherein an illuminance of the light irradiation apparatus is 1 mW/cm$^2$ or more and 50 mW/cm$^2$ or less in a radiation time of 10 seconds or less, and wherein a peak wavelength of a light emitted from the light irradiation apparatus is in a range of 230 nm or more and 330 nm or less.

6. The image forming apparatus for an inkjet recording of claim 5, wherein the surface temperature of the recording medium is controlled at a temperature of 30° C. or higher and at 5 to 30° C. lower than the gelling temperature of the photo-curable inkjet ink.

7. The image forming apparatus for an inkjet recording of claim 5, wherein the gelling temperature of the photo-curable inkjet ink is in a range of 40° C. or more and 80° C. or less.

* * * * *